United States Patent [19]

Sterle

[11] Patent Number: 4,535,513

[45] Date of Patent: Aug. 20, 1985

[54] DETACHABLE DRAPE CLAMP

[75] Inventor: Vinko Sterle, Stari trg pri Lozu, Yugoslavia

[73] Assignee: Roland Sattler, Aufham, Fed. Rep. of Germany

[21] Appl. No.: 494,025

[22] Filed: May 12, 1983

[30] Foreign Application Priority Data

Nov. 13, 1982 [DE] Fed. Rep. of Germany ... MR20 189

[51] Int. Cl.[3] ..... A44B 21/00

[52] U.S. Cl. ..... 24/346; 24/489; 24/536; 24/562

[58] Field of Search ..... 24/346, 345, 347, 348, 24/349, 489, 536, 562

[56] References Cited

U.S. PATENT DOCUMENTS

| | | | |
|---|---|---|---|
| 6,796 | 12/1875 | Smith | 24/348 |
| 1,773,042 | 8/1930 | Jones | 24/345 |
| 2,433,171 | 12/1947 | Tegarty | 24/562 |
| 2,976,593 | 3/1961 | Exton | 24/346 |
| 3,137,027 | 6/1964 | Birkle | 24/536 |
| 3,203,061 | 8/1965 | Thomas | 24/562 |
| 3,214,810 | 11/1965 | Mathison | 24/562 |
| 3,924,303 | 12/1975 | Elliott | 24/536 |
| 4,010,879 | 3/1977 | George et al. | 24/562 |
| 4,279,063 | 7/1981 | Joseph | 24/562 |
| 4,324,125 | 4/1982 | Jarman et al. | 24/536 |

FOREIGN PATENT DOCUMENTS

| | | | |
|---|---|---|---|
| 55548 | 9/1911 | Austria | 24/536 |

*Primary Examiner*—Victor N. Sakran

*Attorney, Agent, or Firm*—Stevens, Davis, Miller & Mosher

[57] ABSTRACT

A clamp for the detachable holding of web-shaped materials, comprising a spring steel clamping strip consisting of two downwardly extending legs having lower free ends and an intermediate section interconnecting said legs at upper ends thereof, a pull bar fastened at one end to the intermediate section and an elongated slide element defining a transverse groove through a portion of said element to define two arms and a longitudinal bore through the ungrooved portion, said bar passing slidingly through said bore and permitting said clamping strip to be completely drawn into said groove to create a bringing together of said legs, the distance between the two arms being less than the distance between the lower free ends of the legs when in an open position, the lower free ends of said legs being bent towards each other and serrated, the legs contacting said arms at only one point when in said groove.

4 Claims, 4 Drawing Figures

FIG. 1
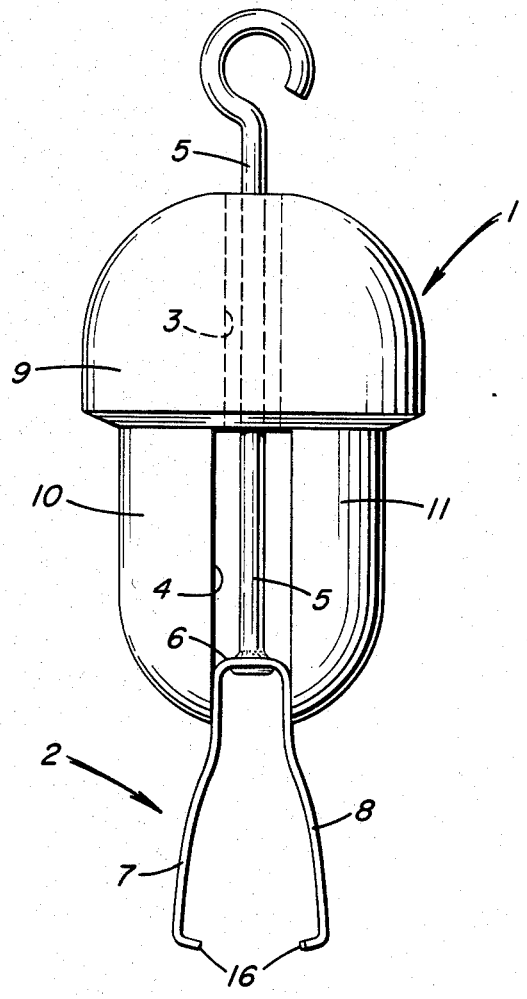
FIG. 2
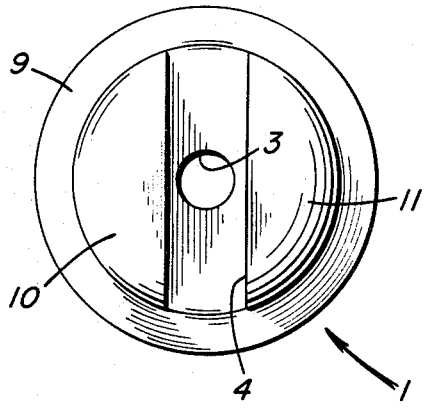
FIG. 4
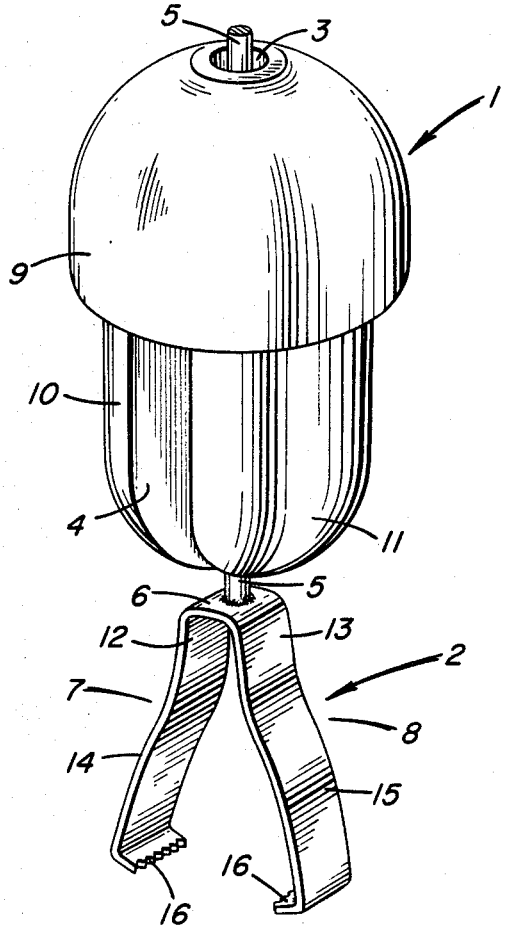
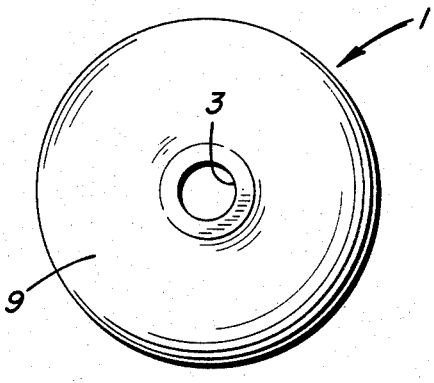
FIG. 3

DETACHABLE DRAPE CLAMP

The present invention relates to a clamp for detachably holding web-shaped materials, particularly drapes such as curtains.

Drape clamps are already known. They consist of two clamp members urged towards each other by a spring and turnably mounted on a common shaft. A ring or a roller element is also fastened to the shaft. The ring or roller element is placed on a curtain rod or rail.

Since the clamp must be opened by hand, the force of the spring is limited, so that the holding force of the clamp frequently leaves something to be desired. Furthermore the known clamps are visible on the curtain, as a result of which the esthetic impression is impaired.

The invention therefore is directed at providing a clamp in particular for the fastening of curtains to curtain rods or rails which has a high holding force while being easy to operate and while of simple construction does not impair the esthetic impression of the curtain Other details and features of the invention will stand out from the description given below by way of non-limitative example and with reference to the accompany drawings, in which:

FIG. 1 shows one embodiment of the clamp of the invention, as seen in side view;

FIG. 2 is a bottom view of the slide part;

FIG. 3 is a plan view of the slide part; and

FIG. 4 is a perspective view of the embodiment.

The clamp consists essentially of a pinch part 2 and a slide part 1.

The pinch part 2 is made of a bent strip-shaped material, preferably spring steel strip which is substantially an inverted U shape i.e. two vertical legs 7 and 8 interconnected by an intermediate section 6. To the intermediate section 6 of the pinch part 2 there is fastened a bar 5. The bar 5 consists of metal, preferably steel. The bar 5 slides in a slide part 1 having a transverse groove section 6 pinch part 2. As the bar 5 slides in the slide part 1 the pinch part 2 is drawn into the groove 4 thereby bringing together the legs 7 and 8 of the strip.

The free ends of the two legs 7, 8 of the pinch part 2 are bent towards each other and are provided with serrations 16 which engage with each other when the clamp is closed.

The slide part 1 consists of a top or main section 9 and two arms 10 and 11 defining the groove 4. In the main section 9 there is provided an axial bore 3, within which the bar 5 is displaceably guided.

When the clamp is in its closed position, the pinch part 2 has the bar 5 pulled between the two arms 10, 11 of the slide part 1.

The slide part 1 is preferably made in a single piece of wood or plastic and has a stylized, natural or geometrical shape, for instance that of an acorn. The arms 10, 11 are formed by a groove 4 in the one-piece slide part 1.

The width of the recess 4 and thus the distance between the arms 10, 11 is so dimensioned that it is less than the distance apart of the ends of the pinch part 2 which are bent towards each other when the clamp is in the open position.

The axial length of the arms 10, 11 of the slide part 1 is somewhat greater than the axial length of the pinch part 2 so that in its closed position with legs 7 and 8 drawn into the groove 4, the pinch part 2 completely disappears in the groove 4 and thus is no longer visible from the front side of the clamp.

The two legs 7, 8 of the pinch part 2 are bent apart from each other near the intermediate section 6 at 12 and 13 and are bent towards each other at the section facing the free ends at 14 and 15. In this way, in its closed position, withdrawn into groove 4, the pinch part 2 lies against the arms 10 and 11 of the slide part 1 only at 14 and 15, as a result of which a particularly high pressure is obtained on the free ends of the legs 7 and 8 and thus a high holding force of the clamp.

The bar 5 is provided with a hook or a roller element on the end thereof facing away from the pinch part 2. The length of the pull bar 5 between the intermediate section 6 of the pinch element 1 and the roller element or hook corresponds approximately to the axial length of the slide part 1, including the arms 10, 11.

If the end of the pull bar 5 facing away from the pinch part 2 is bent into a hook, the hook can be suspended from a ring which is placed on the curtain rod.

I claim:

1. A clamp for the detachable holding of web-shaped materials, comprising a spring steel clamping strip consisting of two downwardly extending legs having lower free ends and an intermediate section interconnecting said legs at upper ends thereof, a pull bar fastened at one end to the intermediate section and an elongated slide element defining a transverse groove through a portion of said element to define two arms and a longitudinal bore through the ungrooved portion, said bar passing slidingly through said bore and permitting said clamping strip to be completely drawn into said groove to create a bringing together of said legs, the distance between the two arms being less than the distance between the lower free ends of the legs when in an open position, the lower free ends of said legs being bent towards each other and serrated, the legs contacting said arms at only one point when in said groove.

2. The clamp according to claim 1, wherein the axial length of the arms corresponds to at least the axial length of the legs.

3. The clamp according to claim 1, wherein the length of the pull bar corresponds approximately to the axial length of the elongated element.

4. The clamp according to claim 1, wherein lower ends of said legs are serrated.

* * * * *